US006386627B1

(12) United States Patent
Tsai

(10) Patent No.: US 6,386,627 B1
(45) Date of Patent: May 14, 2002

(54) REAR LEG-SUPPORTED FOLDABLE CHAIR

(76) Inventor: Frank Tsai, 2F, No. 169, Pa-Te Rd. Sec. 3, Taipei (TW)

( * ) Notice: Subject to any disclaimer, the term of this patent is extended or adjusted under 35 U.S.C. 154(b) by 0 days.

(21) Appl. No.: 09/704,767

(22) Filed: Nov. 3, 2000

(51) Int. Cl.[7] ..... A47C 4/20
(52) U.S. Cl. ..... 297/16.1; 297/55; 297/58
(58) Field of Search ..... 297/16.1, 55, 58

(56) References Cited

U.S. PATENT DOCUMENTS

| | | | | | |
|---|---|---|---|---|---|
| 1,815,643 | A | * | 7/1931 | Allerding | 297/55 |
| 2,262,500 | A | * | 11/1941 | Johannsen | 297/55 |
| 2,303,189 | A | * | 11/1942 | Adler | 297/55 |
| 2,568,269 | A | * | 9/1951 | Burnham et al. | 297/55 |
| 2,654,419 | A | * | 10/1953 | Nordamrk | 297/58 |
| 2,666,478 | A | * | 1/1954 | Shwayder | 297/58 |
| 2,694,442 | A | * | 11/1954 | Nordmark | 297/55 |
| 2,709,482 | A | * | 5/1955 | Schlaak | 297/55 X |
| 2,729,275 | A | * | 1/1956 | Morgan et al. | 297/58 |
| 2,729,279 | A | * | 1/1956 | Axtell et al. | 297/55 |
| 2,729,280 | A | * | 1/1956 | Adler | 297/55 |
| 2,865,437 | A | * | 12/1958 | Shwayder | 297/55 |
| 2,877,829 | A | * | 3/1959 | Ferar et al. | 297/55 |
| 2,918,114 | A | * | 12/1959 | Hendrickson | 297/55 |
| 2,973,803 | A | * | 3/1961 | Mickelson | 297/55 |
| 3,094,357 | A | * | 6/1963 | Shwayder | 297/55 X |
| 3,429,611 | A | * | 2/1969 | Van Ryn | 297/58 |
| 6,131,992 | A | * | 10/2000 | Chang | 297/55 X |
| 6,193,307 | B1 | * | 2/2001 | Lin | 297/55 X |
| 6,279,991 | B1 | * | 8/2001 | Atkins et al. | 297/55 X |

* cited by examiner

*Primary Examiner*—Peter M. Cuomo
*Assistant Examiner*—Rodney B. White
(74) *Attorney, Agent, or Firm*—Dougherty & Troxell

(57) ABSTRACT

Rear leg-supported foldable chair including a front leg, a rear leg, a seat and a linking mechanism. The rear leg is pivotally connected with rear end of the seat. A connecting plate is disposed at top end of the rear leg for pivotally connecting with the front leg. Two fixing bent plates respectively extend from lower edges of two lateral fulcrums of the front leg. Each of the fixing bent plates via a linking rod is connected with the other. The linking rod via a movable plate is pivotally connected with the rear end of the seat to form the linking mechanism. When the chair is unfolded, the fulcrums of the rear leg and the linking mechanism directly welded on the front leg will distributively bear the weight loaded on the seat. The front leg and rear leg are firmly connected with each other so that the foldable chair is more rigid and durable.

4 Claims, 5 Drawing Sheets

REAR LEG-SUPPORTED FOLDABLE CHAIR

BACKGROUND OF THE INVENTION

The present invention relates to a rear leg-supported foldable chair having directly fixed force application points. In addition, the force application point is moved rearward for more stably and evenly distributively bear the weight loaded on the chair.

FIG. 1 shows a conventional foldable chair. The front leg A of the chair is pivotally connected with the seat C by a pin member A1. The rear leg B is pivotally connected with one end of a restricting plate D by a pin member B1. The upper end of the rear leg B is pivotally connected with the front leg by another pin member B2. The other end of the restricting plate D is fixed on the seat C by a pin member D2. The middle of lower edge of the restricting plate is formed with a notch D1. The seat C has a restricting pin C1 for fitting into the notch D1. When the chair is unfolded, the front side of the seat C is depressed and rotated about the pin member A1. At this time, the restricting plate D is rotated along with the seat C. When the restricting pin C1 is fitted into the notch D1 of the restricting plate D, the chair is completely unfolded.

The foldable chair bears a weight entirely at the front legs A and there is no upward supporting force applied to the part between the rear end of the seat C and the pin member A1. As a result, in case a downward force is applied to the rear end of the seat C, the seat C will be turned to rear side and the chair will be folded. Moreover, with the pin member A1 serving as the fulcrum, the rear legs B are totally free from the load coming from the seat C and the pin member A1 will bear all the force. As a result, the pin member A1 tends to damage. Therefore, it is necessary to provide a foldable chair in which the weight loaded on the chair is distributed to the respectively fulcrums, whereby the chair is more rigid and is able to more stably and durably support the weight.

SUMMARY OF THE INVENTION

It is therefore a primary object of the present invention to provide a rear leg-supported foldable chair in which the weight loaded on the foldable chair is evenly distributed over the front and rear fulcrums and the force application points are more rigid so that a user can more stably sit on the foldable chair.

According to the above object, the rear leg-supported foldable chair includes a front leg, a rear leg, a seat and a linking mechanism. The rear leg is pivotally connected with rear end of the seat. A connecting plate is disposed at top end of the rear leg for pivotally connecting with the front leg. Two fixing bent plates respectively extend from lower edges of two lateral fulcrums of the front leg. Each of the fixing bent plates via a linking rod is connected with the other. The linking rod via a movable plate is pivotally connected with the rear end of the seat to form the linking mechanism. When the chair is unfolded, the fulcrums of the rear leg and the linking mechanism directly welded on the front leg will distributively bear the weight loaded on the seat. The front leg and rear leg are firmly connected with each other so that the foldable chair is more rigid and durable.

The present invention can be best understood through the following description and accompanying drawings wherein:

DETAILED DESCRIPTION OF THE PREFERRED EMBODIMENT

Figure 2:
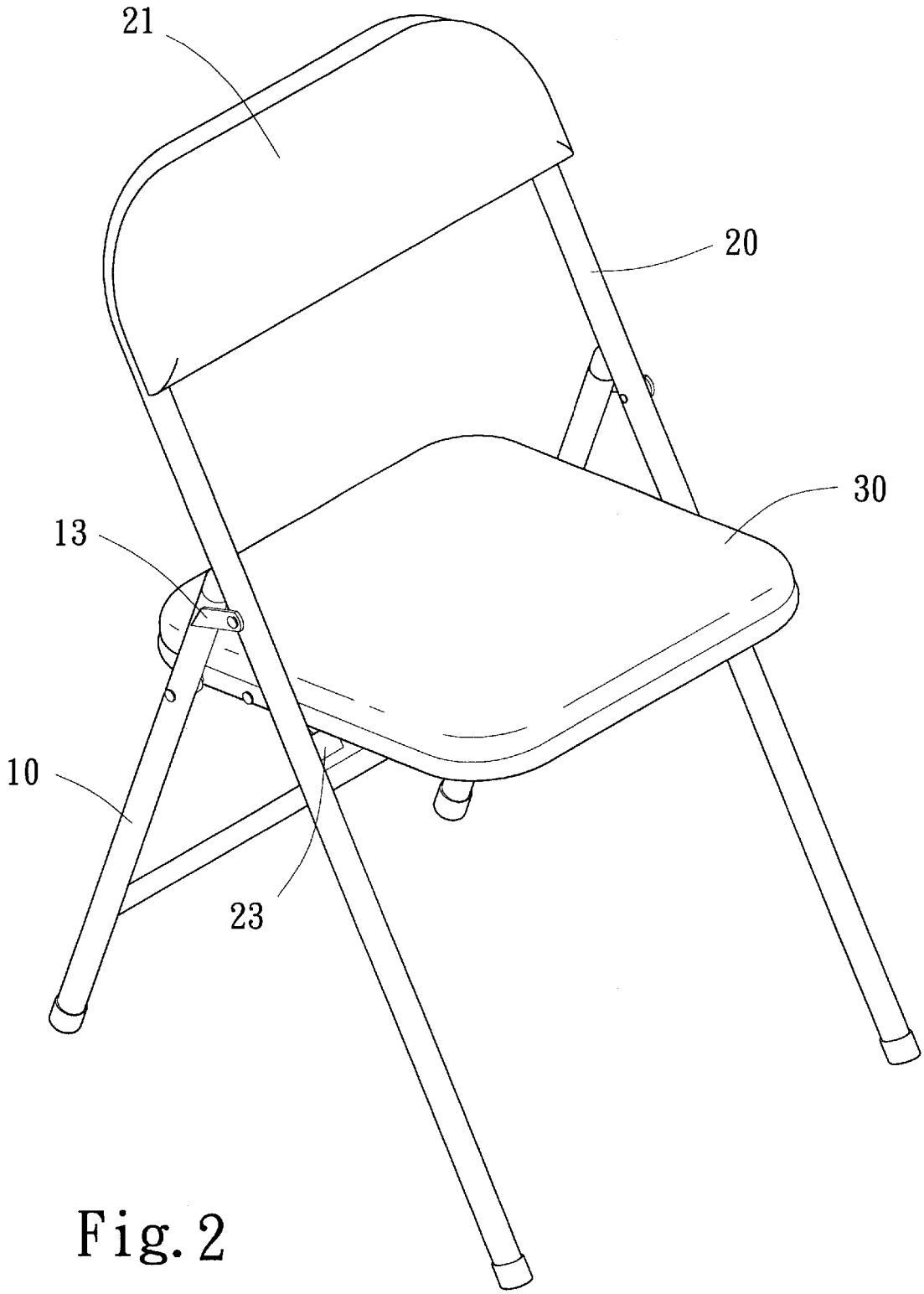
FIG. 2 is a perspective assembled view of the rear leg-supported foldable chair of the present invention.
Figure 3:
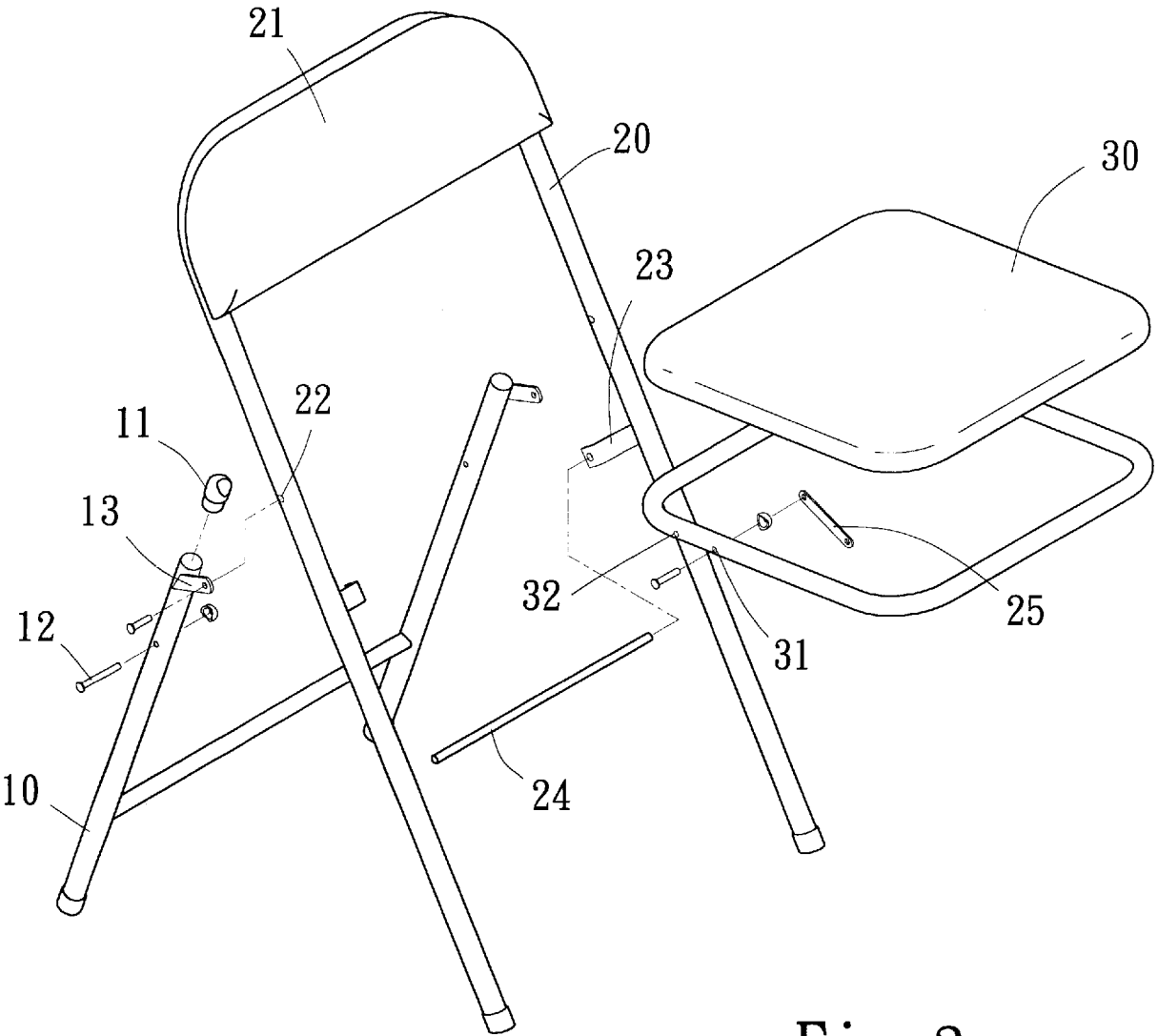
FIG. 3 is a perspective exploded view of the rear leg-supported foldable chair of the present invention.

Please refer to FIGS. 2 and 3. The present invention includes a front leg 20, a rear leg 10, a seat 30 and a linking mechanism.

The front leg 20 is formed of a steel tube which is bent into a reverse U-shaped pattern having a middle concave bridge section. A back pad 21 is laid on the concave bridge section. Two pin holes 22 are respectively formed under the lower edge of the back pad 21 for pivotally connecting with the rear leg 10 by pins. Two fixing bent plates 23 respectively perpendicularly inward extends from the middle of the front leg 20. The free end of each fixing bent plate 23 has a bent section which a linking rod 24 is passed through and welded on. A movable plate 25 pivotally connected with the seat 30 is further pivotally connected with the linking rod 24.

The rear leg 10 is substantially U-shaped or H-shaped. Each top end of the rear leg 10 is disposed with a leaning block 11 having an arch face. An obliquely extending connecting plate 13 is disposed under the leaning block 11. A movable shaft pin 12 is disposed under the connecting plate 13 and pivotally connected with the seat 30.

The seat 30 includes a rectangular frame body with a certain area. A soft seat cushion is mounted on the frame body. The rear portion of each lateral side of the seat 30 is formed with two pin holes 31, 32.

When assembled, the movable shaft pin 12 of the rear leg 10 is fitted into the pin hole 32 of the rear side of the seat 30. Then the connecting plate 13 of the upper end of the rear leg 10 is pivotally connected at the pin hole 22 of upper end of the front leg 20 by pin member. The other end of the movable plate 25 of the linking mechanism of the front leg 20 is pivotally connected at the pin hole 31 of the seat 30.

Figure 1:
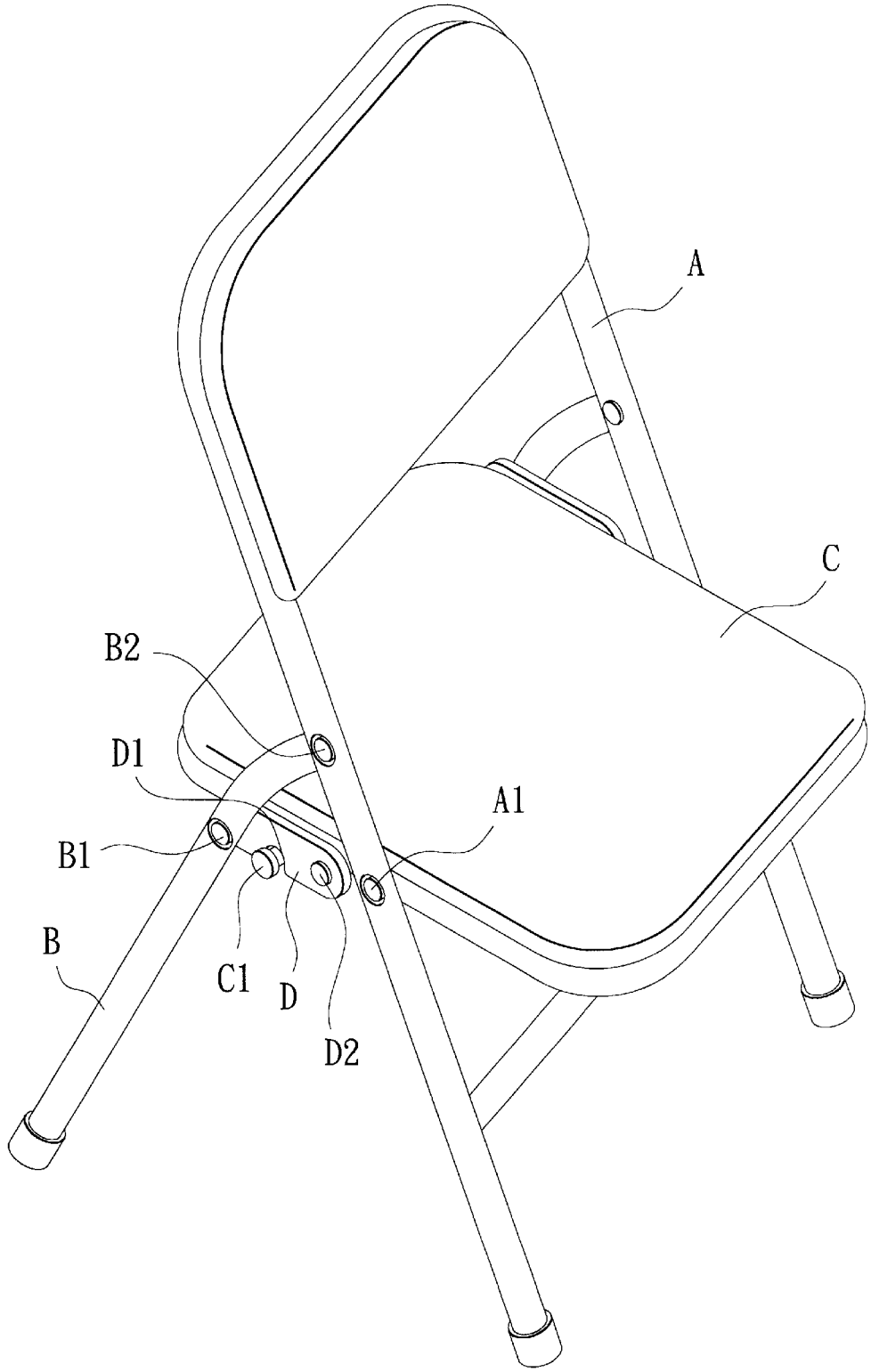
FIG. 1 PRIOR ART
FIG. 1 is a perspective view of a conventional foldable chair.
Figure 4:
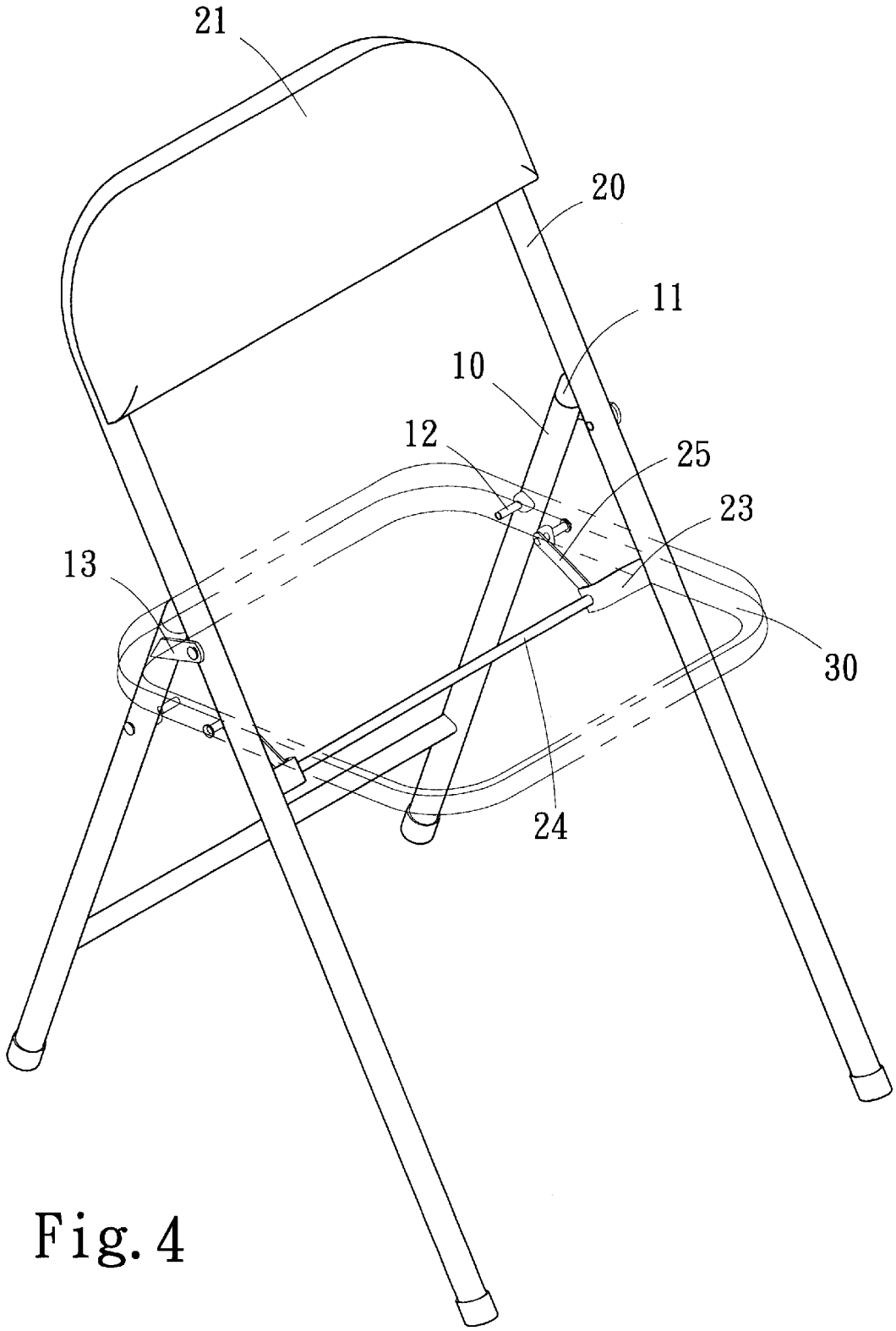
FIG. 4 is a perspective assembled view showing the rear leg-supported foldable chair of the present invention in an unfolded state.

Referring to FIG. 4, the rear leg 10 via the welded connecting plate 13 is pivotally connected with the front leg 20 and via the shaft pin 12 pivotally connected with the seat 30. Therefore, when the seat 30 is depressed, the rear leg 10 itself will stretch rearward. The bottom edge of the seat 30 will lean against the fixing bent plate 23. When the seat 30 bears a weight, the weight is distributed and absorbed by the shaft pin 12 pivotally connected between the rear side of the seat 30 and the rear leg 10 and the fixing bent plate 23 welded on the front leg 20. Therefore, the weight will be evenly distributed over a face formed by four fulcrums rather than a linear fulcrum as the pin member A1 of conventional foldable chair (as shown in FIG. 1). Therefore, the foldable chair of the present invention is able to more stably bear the weight.

Figure 5:
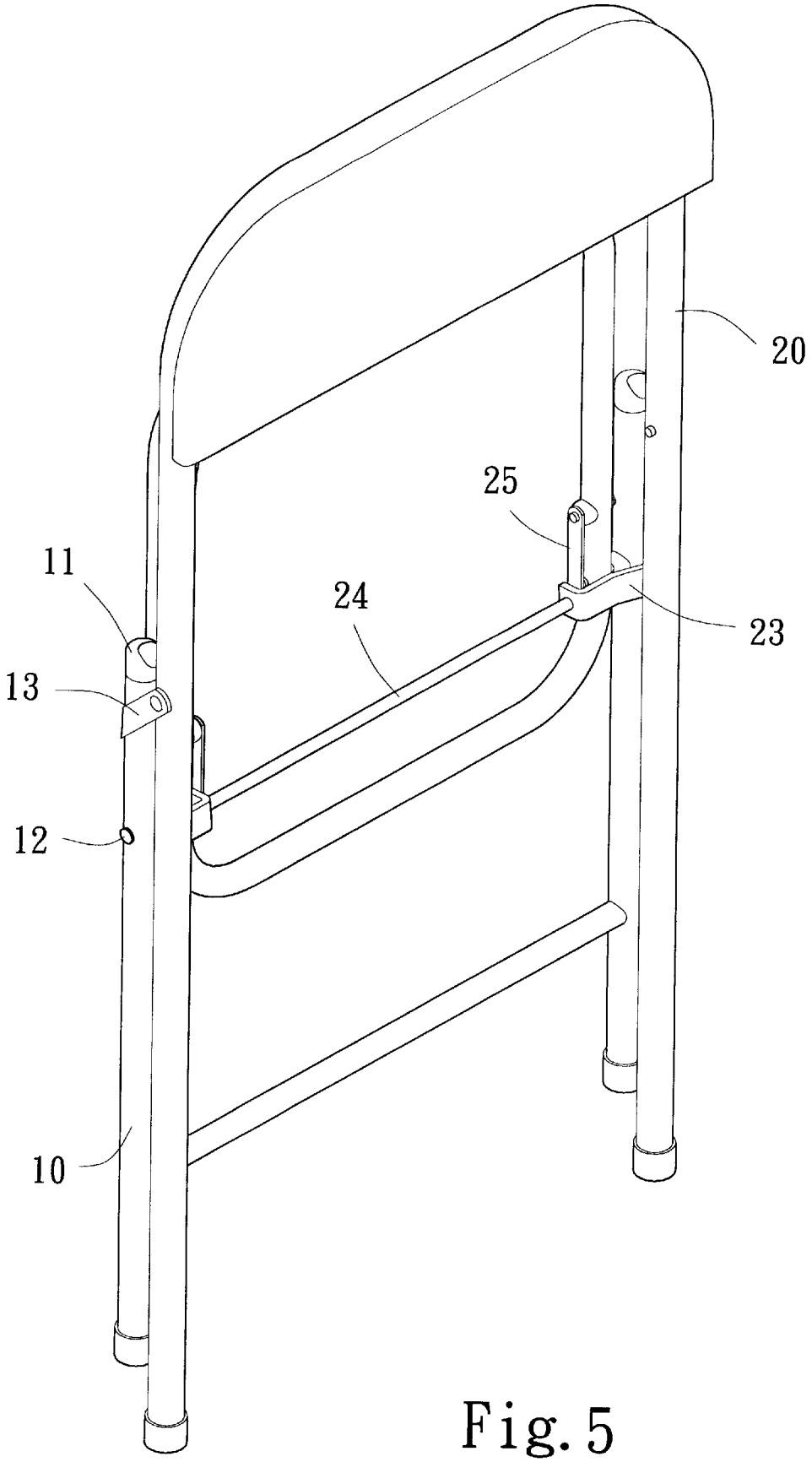
FIG. 5 is a perspective assembled view showing the rear leg-supported foldable chair of the present invention in a folded state.

In addition, the fulcrums of the present invention are positioned at rear half of the seat 30 and the distance between the shaft pin 12 (fulcrum) and the rear end of the seat 30 is very short. Therefore, no matter how closely to the rear end of the seat 30 a user sits on the seat 30, the seat 30 will not be folded rearward. Reversely, the front end of the seat 30 is considerably far away from the shaft pin 12 (fulcrum), a user only needs to apply little upward force onto the seat 30 for lifting the seat and folding the chair (as shown in FIG. 5). This is very convenient to the user. Furthermore, the present invention is assembled mostly by direct welding rather than by pin holes and pin members as the conventional foldable chair (as shown in FIG. 1). Therefore, the assembling procedure and time are reduced.

According to the above arrangement, the weight loaded on the foldable chair of the present invention is evenly distributed over the front and rear fulcrums so that a user can more stably sit on the foldable chair.

The above embodiment is only used to illustrate the present invention, not intended to limit the scope thereof. Many modifications of the above embodiment can be made without departing from the spirit of the present invention.

What is claimed is:

1. Rear leg-supported foldable chair comprising a pair of front legs, a pair of rear legs each having a top end, a seat having a rear end, and a linking mechanism, the rear legs being pivotally connected with the rear end of the seat, a connecting plate disposed at the top ends of the rear legs for pivotally connecting with the front legs, a lateral fulcrum on each of the front legs and two fixing bent plates respectively extending from lower edges of two lateral fulcrums of the front legs, each of the fixing bent plates via a linking rod being connected with one another, the linking rod via a movable plate being pivotally connected with the rear end of the seat to form the linking mechanism.

2. Rear leg-supported foldable chair as claimed in claim 1, wherein the connecting plates are obliquely directly welded on the rear legs.

3. Rear leg-supported foldable chair as claimed in claim 1, wherein the top ends of the rear legs are fitted with a leaning block having an arch face.

4. Rear leg-supported foldable chair as claimed in claim 1, wherein the fixing bent plates are directly welded on the front legs.

* * * * *